United States Patent [19]

Lusk et al.

[11] Patent Number: 4,685,378

[45] Date of Patent: Aug. 11, 1987

[54] BLANK FIRING ATTACHMENT FOR MACHINE GUN

[76] Inventors: Norman E. Lusk, R.R. 1, Seeleys Bay, Ontario; Ian J. Anderson, 26 Hickory Hill Crescent, Kitchener, Ontario, both of Canada

[21] Appl. No.: 798,863

[22] Filed: Nov. 18, 1985

Related U.S. Application Data

[63] Continuation-in-part of Ser. No. 527,389, Aug. 29, 1983.

[30] Foreign Application Priority Data

Oct. 14, 1982 [CA] Canada ..... 413408

[51] Int. Cl.[4] ..... F41F 17/12

[52] U.S. Cl. ..... 89/14.5

[58] Field of Search ..... 89/14.5

[56] References Cited

U.S. PATENT DOCUMENTS 2,339,777 1/1944 Green ..... 89/14.5

2,805,602 9/1957 Moore ..... 89/14.5

*Primary Examiner*—John F. Terapane

*Assistant Examiner*—John S. Maples

*Attorney, Agent, or Firm*—William R. Hinds

[57] ABSTRACT

An attachment for a maching gun with automatic firing mechanism operated by barrel recoil has a tubular jacket positionable over the barrel. A rear end of the jacket is securable to the gun casing and its forward end surrounds the muzzle of the barrel. A restrictor screws into the forward end of the jacket and slides over the barrel muzzle to form a chamber between the muzzle and a transverse wall of the restrictor. Overpressure relief ports are formed in the transverse wall of the restrictor, and exhaust ports are located in the side wall. Gas pressure is built up in the chamber after a blank round has been fired to cause the barrel to recoil a sufficient amount to actuate the automatic firing mechanism. Once the barrel recoils past the exhaust ports, the gas pressure is released to stop the recoil motion. The recoil stroke and rate of fire are adjusted by adjusting the position of the restrictor in the jacket, to adjust the position of the exhaust ports.

10 Claims, 3 Drawing Figures

BLANK FIRING ATTACHMENT FOR MACHINE GUN

REFERENCE TO RELATED APPLICATION

This application is a continuation-in-part of copending application Ser. No. 527,389, filed Aug. 29, 1983.

FIELD OF THE INVENTION

This invention relates to attachments for machine guns to enable blank rounds to be fired.

BACKGROUND

Some machine guns have automatic firing mechanisms operated by barrel recoil produced by each live bullet as it is fired. Since blank rounds used for training purposes do not have bullets, such machine guns are not capable of firing automatically when blanks are used. This has led to the development of blank firing attachments that use the pressure of gases generated in firing blank rounds to cause barrel recoil.

The known blank firing attachments cannot be easily or reliably adjusted for the correct rate of fire and cannot be adjusted to fire automatically in the temperature extremes encountered, for example, in Canade and Northern Europe. Other problems include difficulties in cleaning and maintenance, and the requirement to replace the service barrel with a barrel dedicated to blank firing.

SUMMARY

According to the invention there is provided, for use with a machine gun of the type having a casing, a barrel having a breech end adjacent the casing, a muzzle remote from the casing and a bore of known cross sectional area, and an automatic firing mechanism operated by barrel recoil relative to the casing, a blank firing attachment comprising:

a tubular jacket adapted to be positioned over the barrel and having a rearward end adapted to be secured to the casing, the length of the jacket being such that when it is positioned over the barrel and secured to the casing, a forward end of the jacket surrounds the muzzle;

a restrictor having a tubular wall positionable with a sliding fit over a forward portion of the barrel adjacent the muzzle, a transverse wall that extends across the muzzle when the tubular wall is positioned over the forward portion of the barrel so as to define a chamber bounded by the muzzle, the tubular wall and the transverse wall, means defining one or more over pressure relief openings in the transverse wall of the restrictor, in communication with the chamber, the over pressure relief openings having a cross sectional area substantially smaller than the cross sectional area of the barrel bore, and means defining one or more exhaust ports through the tubular wall of the restrictor at a predetermined distance from the transverse wall, the exhaust ports having a total cross sectional area greater than the cross sectional area of the barrel bore; and mounting means for mounting the restrictor on the forward end of the jacket, including adjustment means for adjusting the position of the restrictor along the jacket.

In use, firing a blank round causes gas pressure to accumulate in the restrictor chamber and forces the barrel to the rear until the exhaust ports are uncovered to release gas pressure from the chamber. Proper adjustment of the restrictor ensures that the recoil stroke is sufficient to operate the automatic firing mechanism of the gun.

The adjustment means may comprise interengaging screw threads on the interior of the jacket and the exterior of the restrictor's tubular wall. Rotation of the restrictor in the jacket adjusts the longitudinal position of the restrictor and the exhaust ports relative to the jacket and the barrel muzzle, thus adjusting the rate of automatic fire to correct for temperature and other factors.

BRIEF DESCRIPTION OF THE DRAWINGS

In the accompanying drawings, which illustrate an exemplary embodiment of the present invention.

DETAILED DESCRIPTION

Figures 1, 2, 3:
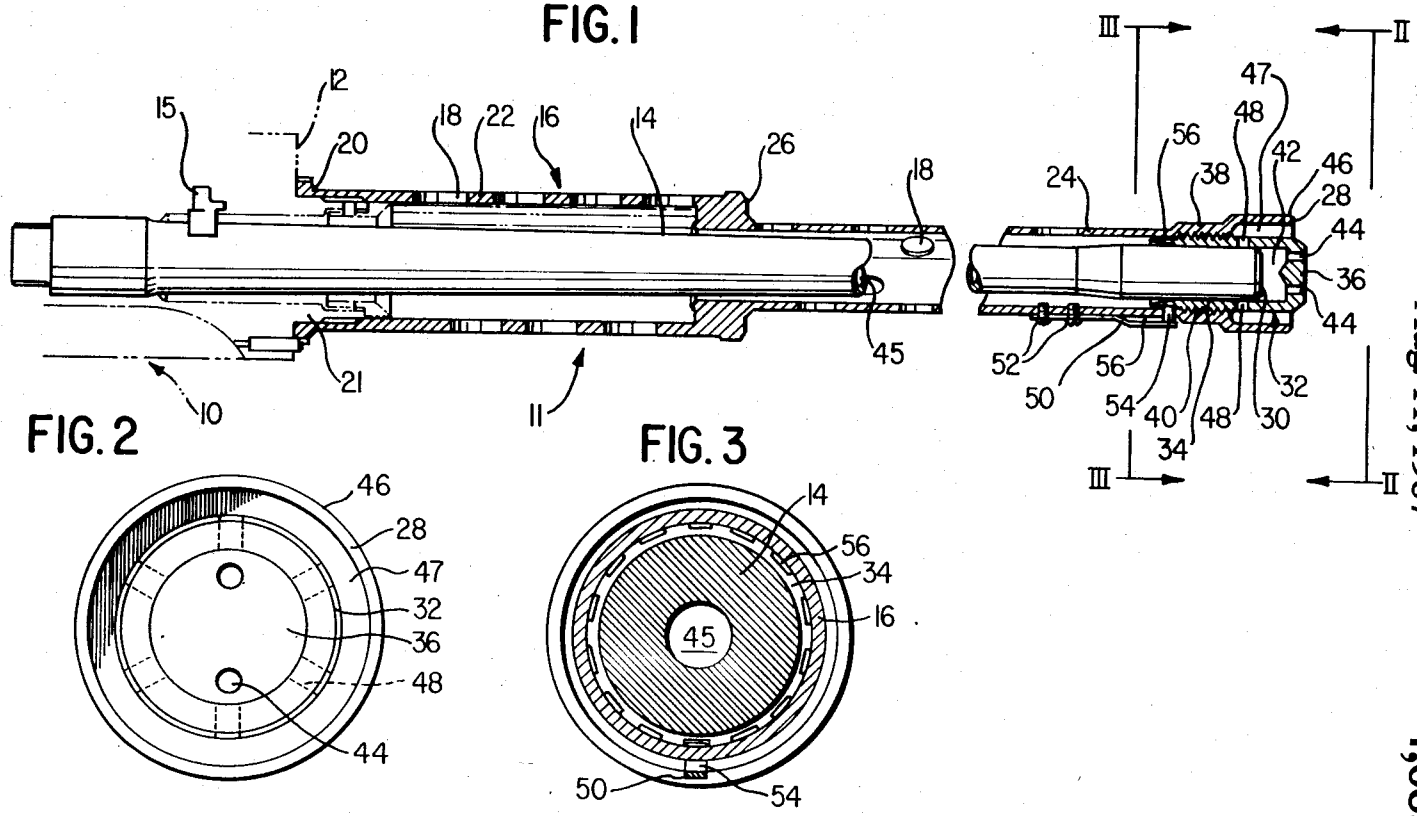
FIG. 1 is a side view, partly in section, of the barrel and part of the casing of a machine gun with a blank firing attachment in accordance with the invention secured thereto.
FIG. 2 is as a view along line II—II of FIG. 1.
FIG. 3 is a sectional view along line VII—VII of FIG. 1.

Referring to the drawings, a machine gun 10 of known kind has the barrel 14 mounted in the casing 12, the barrel 14 being mounted for recoil movement relative to the casing 12 when a live bullet is fired so that such recoil operates an automatic firing mechanism (not shown) in the casing in a manner which is well known to a person skilled in the art.

A blank firing attachment 11 is attached to the gun 10. It comprises a tubular jacket 16 positionable over the barrel 14 in radially spaced relationship thereto, the jacket 16 having apertures 18 spaced along its length and around its circumference for cooling and also weight reduction.

The rearward end 20 of the jacket 16 screws onto a sleeve 21 on the casing 12 to which a conventional barrel support is usually secured. Approximately the rear half 22 of the jacket 16 is of larger diameter than the forward half 24, so that the annular spacing betwen the forward half 24 of the jacket 16 and the barrel 14 is smaller than that between the rear half 22 and the barrel 14. The rear half 22 of the jacket 16 joins the forward half 24 at a forwardly facing shoulder 26. The length of the attachment is such that the forward end 28 of the jacket surrounds and projects slightly beyond the muzzle 30 of the barrel 14.

The attachment also includes a restrictor 32 with a tubular wall 34 and a transverse end wall 36. The tubular wall 34 of the restrictor 32 has an external thread 40 that is screwed into an internal thread 38 in the jacket 16, spaced slightly to the rear from its forward end. The restrictor 32 fits over a forward portion of the barrel adjacent the muzzle 30 with a sliding fit to form a chamber 42 bounded by the muzzle 30, the tubular wall 34 and the transverse wall 36 of the restrictor. The transverse wall 36 of the restrictor 32 extends across the muzzle. It contains two overpressure relief openings 44 with a total cross sectional area less than the cross sectional area of the barrel bore 45.

The jacket 16 has a foremost deflector section 46 of larger diameter than the adjacent threaded portion so as to provide an annular space 47 between the deflector section 46 and the tubular wall 34 of the restrictor 32.

The tubular wall 34 of the restrictor 32 has six radial exhaust ports 48 at a predetermined position to the rear from transverse wall 36. The positioning is such that the ports 48 are normally closed on the inside by the barrel 14 and open on the outside into annular space 47 as shown in FIG. 1.

An axially extending leaf spring 50 is secured at its rear end to the outside of the forward half 24 of the jacket 16 by a pair of screws 52 screwed into threaded apertures in the jacket 16. The forward end of the leaf spring 50 carries a stud 54 which extends through an aperture in the jacket 16 into one of a series of axially-extending circumferentially spaced grooves 56 in the rear end of the tubular member 32.

Normally, that is to say when the gun is not being fired, the jacket 16, tubular member 32 and barrel 14 are in the relative positions shown in FIG. 1, with the exhaust ports 48 in the restrictor 32 covered by the barrel 14. When a blank round is fired, expanding gases will be ejected from the muzzle 30 of the barrel 14 into the chamber 42. Overpressure relief openings 44 in the otherwise closed transverse wall 36 of restrictor 32 only permit a limited amount of gas escape so that gas pressure builds up in the chamber 42 and produces a recoil force on the muzzle end 30 of the barrel 14, which therefore recoils a sufficient amount to cause the automatic firing mechanism in the casing 12 to be actuated. When the barrel 14 has recoiled for a predetermined distance, the barrel 14 uncovers the exhaust ports 48 in the restrictor 32 to release the gas pressure in the chamber 42 by exhausting the high pressure gases into the annular space 47 between the deflector section 46 of the jacket 16 and the tubular wall 34 of restrictor 32.

The axial position of the restrictor 32 relative to the barrel 14 can be adjusted by releasing the locking stud 54 from the groove 56 and screwing the restrictor 32 axially inwardly or outwardly relative to the jacket 16 to adjust the position of the exhaust ports 48 relative to the muzzle 30 of the barrel 14, and thereby adjusting the length of recoil stroke over which the pressure in the chamber 42 acts on the barrel 14 when a blank round is fired. Adjusting the length of the recoil stroke adjusts the rate of fire of the machine gun, as will be understood by those skilled in the art. Such adjustments can also be used to compensate for variations in ambient temperature, variations in different lots of ammunition, and to vary the recoil force.

The deflector section 46 of the jacket 16 directs all exhaust, smoke and flame in the forward direction from the muzzle of the barrel, that is to say away from personnel and flammables which may be positioned under the gun.

In the described embodiment, the breech end of the barrel 14, adjacent the casing, is provided with a discriminator in the form of a lug 15 to prevent live rounds being fired. The discriminator 15 will engage any live round as it is fed to the gun to prevent chambering of the round, thereby causing automatic fire to cease.

Where desired, the barrel 14 may be of considerably less weight than a barrel used for live rounds, and may for example be half the normal weight, thereby halving the recoil mass. This is not necessary, however, and the attachment can equally be used with a service barrel for firing live rounds.

The advantage of the present invention will be readily apparent to a person skilled in the art from the foregoing description of a preferred embodiment, the scope of the invention being defined in the appended claims.

We claim:

1. For use with a machine gun of the type having a casing, a barrel breech with a end adjacent the casing, a muzzle remote from the casing and a bore of known cross sectional area, and an automatic firing mechanism operated by barrel recoil relative to the casing, a blank firing attachment comprising:

a tubular jacket adapted to be positoned over the barrel and having a rearward end adapted to be secured to the casing, the length of the jacket being such that when it is positioned over the brrel and secured to the casing, a forward end of the jacket surrounds the muzzle;

a restrictor having a tubular wall positionable with a sliding fit over a forward portion of the barrel adjacent the muzzle, a transverse wall that extends across the muzzle when the tubular wall is positioned over the forward portion of the barrel so as to define a chamber bounded by the muzzle, the tubular wall and the transverse wall, means defining one or more over pressure relief openings in the transverse wall of the restrictor, in communication with the chamber, the over pressure relief openings having a cross sectional area substantially smaller than the cross sectional area of the barrel bore, and means for defining one or more exhaust ports through the tubular wall of the restrictor at a predetermined distance from the transverse wall, the exhaust ports having a total cross sectional area greater than the cross sectional area of the barrel bore; and mounting means for mounting the restrictor on the forward end of the jacket, including adjustment means for adjusting the position of the restrictor along the jacket for movement towards and away from the casing.

2. An attachment according to claim 1, wherein the forward end of the jacket comprises a deflector section of larger internal diameter than the external diameter of the tubular wall of the restrictor so as to provide an annular space between the deflector section and the tubular wall of the restrictor, the exhaust ports opening into the annular space and the annular space being open at its front end.

3. In combination, a machine gun having a casing, a barrel having a breech end adjacent the casing, a muzzle remote from the casing and a bore of known cross sectional area and an automatic firing mechanism operated by barrel recoil relative to the casing, and an attachment as defined in claim 1 positioned over the barrel and secured to the gun casing.

4. An attachment according to claim 1, wherein the adjustment means comprises interengaging screw threads on the interior of the jacket and the exterior of the tubular wall of the restrictor.

5. An attachment according to claim 4 wherein said adjustment means further comprise a plurality of circumferentially spaced, axially extending grooves formed in said restrictor, and an exteriorly accessible, manually releasable stud movably mounted on said jacket for selective engagement with any of said grooves to hold said restrictor in any of a plurality of axially-adjusted positions effected by screwing said restrictor relative to said jacket.

6. An attachment according to claim 5 wherein said stud is spring-loaded to its groove engaging position.

7. An attachment according to claim 1 wherein said adjustment means comprises exteriorly accessible, manually releasable locking means for holding said restrictor selectively in any of a plurality of axially adjusted positions along said jacket.

8. An attachment according to claim 7 wherein said locking means comprises at least one male member carried by one of the restrictor and the jacket for releasably engaging in any of a plurality of axial-position-defining female formations carried by the other of the restrictor and the jacket.

9. An attachment according to claim 8 wherein said male member is a spring-loaded stud movably mounted on the jacket for selectively engaging any of said female formations carried by the restrictor.

10. For use with a machine gun of the type having a casing, a unitary barrel with a rearward end coupled to the casing and a forward end extending from the casing, and an automatic firing mechanism operated by barrel recoil relative to the casing caused by the firing of a live bullet, a blank firing attachment comprising: a cylindrical jacket positionable over the barrel, said cylindrical jacket having a rear end portion securable to the gun casing and a forward end portion which in use surrounds the forward end of the barrel, and a chamber-forming tubular member with an open rear end and a substantially closed but partially open forward end, the tubular member being positionable over the forward end portion of the barrel with a sliding fit to form a chamber between the forward end of the barrel and the substantially closed but partially open forward end of the tubular member, and means for securing the tubular member to the cylindrical jacket, the substantially closed but partially open forward end of the tubular member in use retaining a sufficient gas pressure in the chamber after a blank round has been fired to cause the barrel to recoil a sufficient amount to actuate the automatic firing mechanism, the tubular member having an aperture therein locatable in use a predetermined distance rearwardly from the front end of the barrel so as to be uncovered after the barrel has moved a predetermined recoil distance to relieve gas pressure from the chamber, and the means for securing the tubular member to the cylindrical jacket comprising adjustment means for adjusting the position of the tubular member on the jacket to enable the recoil distance required to uncover the aperture to be adjusted, the jacket having a front end portion of larger diameter than the tubular member so as to provide an annular space between the tubular member and the front end portion of the jacket, said aperture of said tubular member opening into said annular space, and said annular space being open at its front end, such that gas and exhaust flame from the aperture in the tubular member pass in a forward direction through said annular space after the aperture has been uncovered.

* * * * *